US005168817A

United States Patent [19]

Nulle et al.

[11] Patent Number: 5,168,817

[45] Date of Patent: Dec. 8, 1992

[54] ONE-PIECE PALLET

[75] Inventors: Henner Nulle, Bolivar; Dale R. Hart, Massillon, both of Ohio; Edmund Munk, Oberstenfeld, Fed. Rep. of Germany

[73] Assignee: Inca Presswood-Pallets, Ltd., Dover, Ohio

[21] Appl. No.: 697,934

[22] Filed: May 8, 1991

[30] Foreign Application Priority Data

Nov. 16, 1990 [DE] Fed. Rep. of Germany ..... 4036518
Nov. 16, 1990 [DE] Fed. Rep. of Germany ..... 4036519

[51] Int. Cl.[5] ..... B65D 19/44
[52] U.S. Cl. ..... 108/51.1; 108/901
[58] Field of Search ..... 108/51.1, 901, 53.1, 108/53.3

[56] References Cited

U.S. PATENT DOCUMENTS 3,628,468 12/1971 Angelbeck, Jr. ..... 108/901 X
4,013,020 3/1977 Shoeller ..... 108/901 X
4,403,555 9/1983 Forrest ..... 108/901 X
4,674,414 6/1987 Nülle et al. ..... 108/901
4,838,176 6/1989 Bowser, Sr. et al. ..... 108/901 X
4,848,247 7/1989 Kuipers ..... 108/901 X

*Primary Examiner*—Peter A. Aschenbrenner
*Attorney, Agent, or Firm*—Porter, Wright, Morris & Arthur

[57] ABSTRACT

An improved pallet is provided that has a support surface sloped from the outside edges or perimeter to the center of the pallet so that boxes stacked on the pallet will tend to lean toward the center of the pallet. The pallet also is provided with ventilation holes arranged in the surface of the pallet to be aligned with ventilation holes in fruit and vegetable boxes stacked thereon so that cooling air may be circulated through the bottom of the pallet and up through the boxes. Racking members are also provided on the underside of the pallet to offer structural integrity when the pallet is resting on racks.

1 Claim, 3 Drawing Sheets

ONE-PIECE PALLET

BACKGROUND AND SUMMARY OF THE INVENTION

The present invention relates generally to pallets for use in transporting goods. More particularly, the present invention relates to a ventilated pallet having many advantageous features for transporting food stuffs, such as fruits and vegetables.

Pallets in general are known in the art. Load bearing pallets have been in use for many years and are designed to support a work load above a floor surface, thereby enabling lift means, such as a forklift truck to get under the pallet for transporting it to various locations. Typically, such pallets are manufactured from either metal or wood.

Many known pallets are assembled with the use of screws and/or nails. However, there is a disadvantage in having to assemble pallets in this way, because the screws and/or nails may protrude and damage goods carried on the pallets. Today, it is known to make pallets in a one-piece, unitary design. These pallets may be made of molded plastic or pressed fibers, such as wood chips. Pallets of this kind are described in U.S. Pat. No. 3,611,952 and European Patent EP-B1-179 927. The EP-B1-179 927 patent is incorporated by reference herein.

In the transport of food stuffs on pallets, there is often a need to cool during transport so that ripening does not occur. Ordinarily, boxes or crates of fruit are stacked manually onto a pallet. The boxes have ventilation holes in their bottoms for passage of cool air to keep the fruit from ripening during transport. Typically, pallets loaded with boxes (in some instances six boxes per layer, eight layers high for a total of 48 boxes per pallet) are loaded onto a truck or train car equipped with refrigeration means. One of the unique features of the present invention is ventilation holes in each pallet which align with ventilation holes in the bottom of each box loaded on the pallet to improve air flow throughout all of the food stuffs being transported.

When a large number of cartons or boxes are stacked on a pallet, it has been found that between the stacks there occur gaps which increasingly widen from the bottom upward. This is attributable to the fact that either the support surface of the pallets yields slightly at the edges and/or the stacked cartons compress one another. In its worst form, this problem can cause the boxes to topple off of the pallet, spilling their contents. It is therefore, desirable to prevent the gaps between stacks of boxes from occurring. The pallet of the present invention provides a solution to this problem in that the support surface of the pallet has an inclined design from the center of the pallet to the outside edges. When stacks of cartons or boxes are arranged on the pallet of the present invention, the boxes contained in the outer stacks will lean slightly inward, toward the center of the pallet. The widening gap that used to occur between center rows of boxes and outside rows of boxes, will no longer occur.

To accommodate the drive-thru racking system found in many fruit ripening rooms, special racking members may be added to the pallet of the present invention on the underside of the pallet deck or surface. Nearly all racking systems will support the pallet on the long side of the pallet, leaving the shorter side as a free span between the rack supports. In light of this, racking members were added to each long side of the pallet. The racking members support the free span load better than if the pallet deck were resting directly on the rack supports. The racking members act as a gusset between the pallet deck and the pallet feet while at the same time providing a flat surface for the rack support to rest on. This design greatly reduces the stresses that occur at the deck/feet connection and will therefore eliminate failure at this location. A smaller free span deflection will also be achieved by distributing the forces more onto the racking members.

The main purpose of the vent holes of the present invention is to facilitate and enhance ventilation typically by a forced draft fan of cool air up through the bottom deck of the pallet and through the holes in the boxes that are stacked directly above each vent hole. Each box may have a vent hole on the bottom, sides and top. Without the holes in both the boxes and the pallet air flow through the contents of the boxes (e.g. fruit, vegetables, etc.) would be greatly reduced and spoiling may occur due to a build-up of heat.

The vent holes in the formed pallet are unique compared to other pallets. The vent holes in the pallet of the present invention are placed in the bottom portion of the strengthening ribs that surround each vent hole. This design serves to strengthen the area around each vent hole by allowing the ribs, not the holes, to absorb the stresses. The required size hole opening for proper ventilation is too large to ensure proper pallet flexural strength and rigidity in racking systems and pallet handling systems if the vent hole were placed on the top deck surface. With the angled rib design, the actual free space opening may expand by approximately 125% of the actual pallet vent hole in the bottom portion of the rib. This allows a smaller hole to be used while maintaining the preferred opening at the deck surface. The rib contour may be designed to promote better air flow by gradually allowing the air to expand to fill the opening before it comes into contact with the box opening. The vent holes may incorporate all rounded corners at the air intake side. This improves air flow by eliminating any sharp edges that would cause greater resistance to air flow.

DESCRIPTION OF PREFERRED EMBODIMENT(S)

Figure 1:
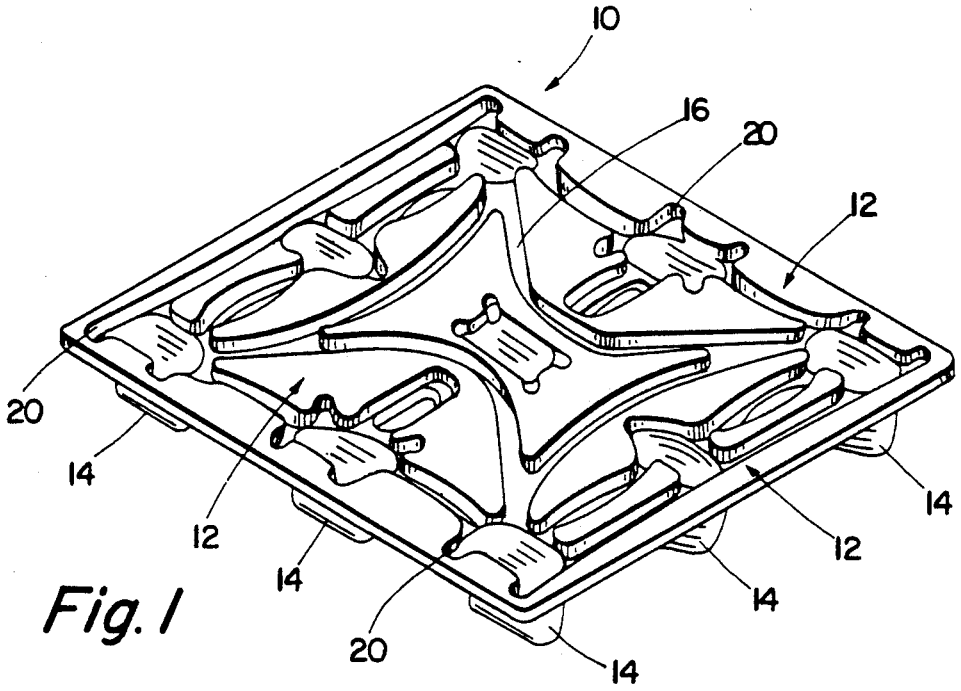
FIG. 1 is a perspective view of a preferred embodiment of the pallet of the present invention.

Referring now to the drawings, and particularly FIG. 1, a pallet 10 is illustrated, that is made from a one-piece design therefore, requiring no assembly which eliminates the need for nails, screws, etc. The pallet of the present invention may preferrably be manufactured with known presswood construction. Presswood construction is accomplished by flaking wood chips to a particular size, drying the flakes, mixing the wood flakes with a resin, then pressing the wood chips and resin together in a mold to form the pallet. Ingredients in a molded presswood pallet are the wood fibers, such as lignocellulose fibers, shredded and dried wood chips, cane trash fibers, and a thermo-setting synthetic resin, such as melamine ureaformaldehyde or phenoloformaldehyde resin. The pallet 10 could also be made from molded plastic.

Figure 6:
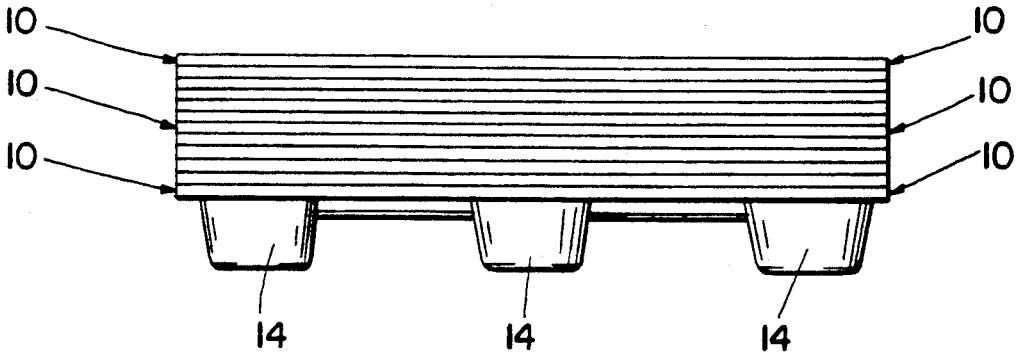
FIG. 6 is a side view of several pallets nested together.

The deck or top surface 12 is generally smooth except where interrupted by strengthening ribs 16 provided in predetermined patterns on the pallet 10 to accommodate the stresses imposed when the pallet 10 has a load thereon. A plurality of feet 14 are provided to raise the deck 12 from the floor by a few inches when the feet 14 are resting on the floor. This allows a forklift to approach and lift the pallet 10 from any of the four sides of the pallet 10. The feet 14 are hollow depressions in the pallet 10 that may accommodate the feet 14 of other pallets 10 within their hollow portions to allow nesting of several pallets 10 as shown in FIG. 6.

Figure 2:
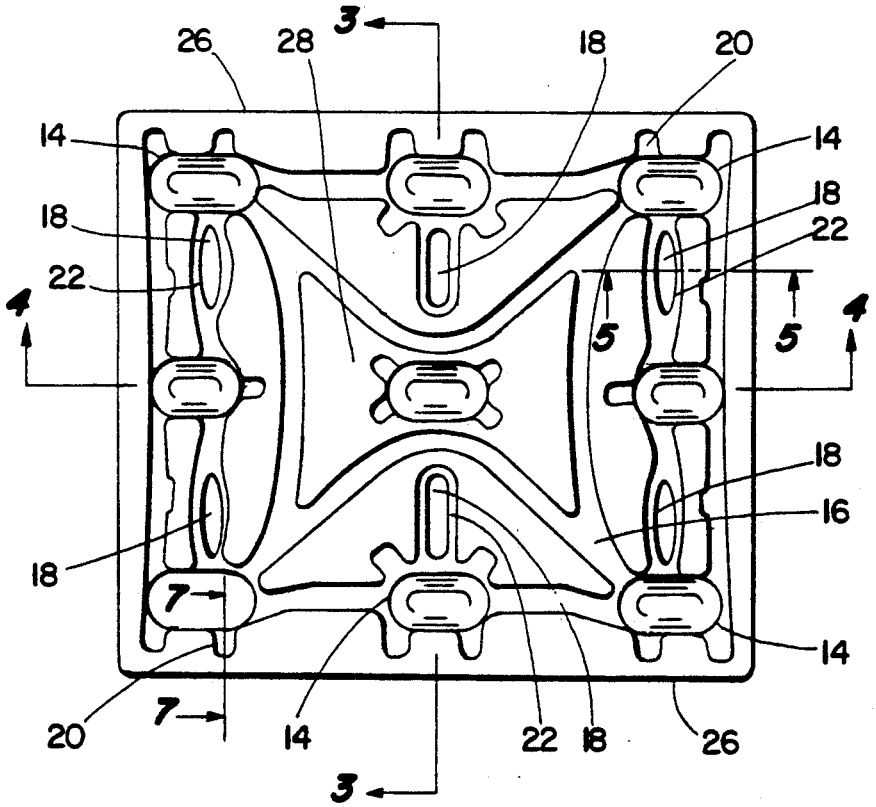
FIG. 2 is a plan view of the pallet of FIG. 1.
Figure 3:
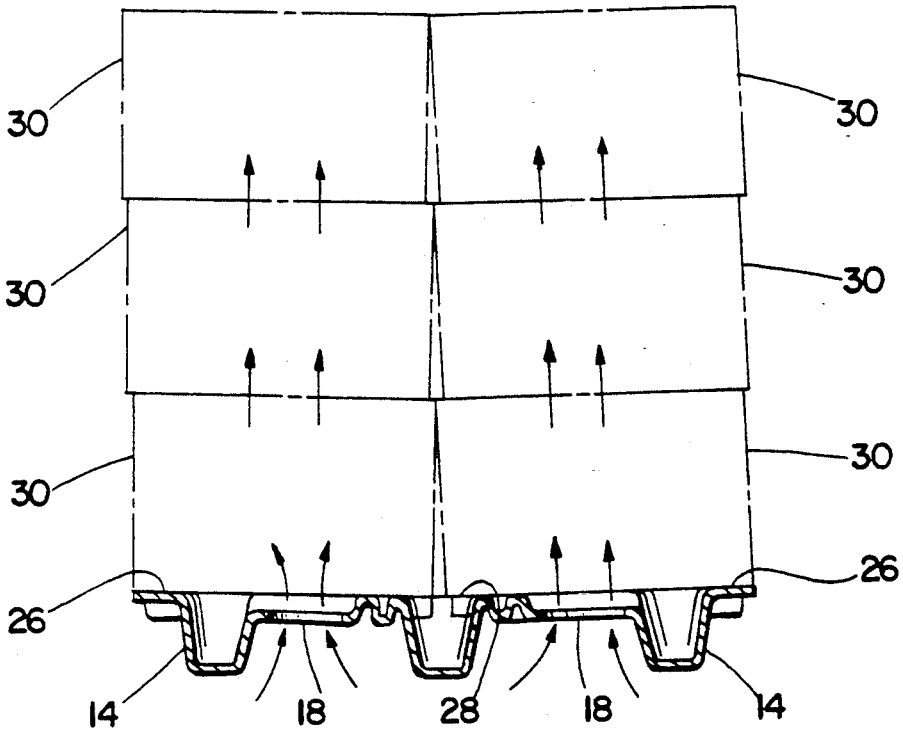
FIG. 3 is a section view taken along line 3—3 of FIG. 2, showing boxes in phantom stacked on the pallet.
Figure 5:
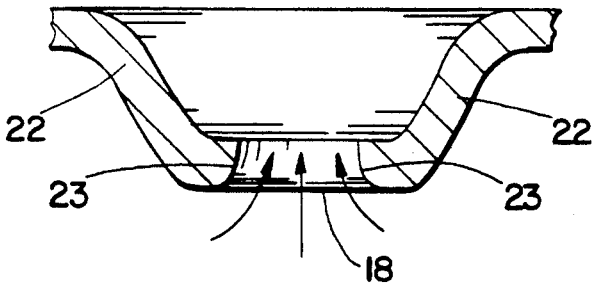
FIG. 5 is a section view taken along line 5—5 of FIG. 2, showing a ventilation opening in the pallet.

The pallet 10 is provided with a number of ventilation openings 18 formed in ribs 22. As shown in FIG. 2, in a preferred embodiment of the present invention, six ventilation holes 18 are provided and are located on the pallet 10 in such a way so as to be in alignment with ventilation holes in boxes 30 as shown in FIG. 3. Referring to FIG. 5, a detail of a typical ventilation hole is illustrated, wherein the hole 18 is formed in a rib 22 of the pallet 10. The hole 18 is contoured within the rib 22 to have a substantially smooth passage through the rib preferably without sharp protruding edges to cause an air drag. The walls 23 of the hole 18 may be designed to act as an air nozzle. The arrows in FIG. 3 indicate how the air flows through the openings 18 and into the boxes 30.

Figure 4:
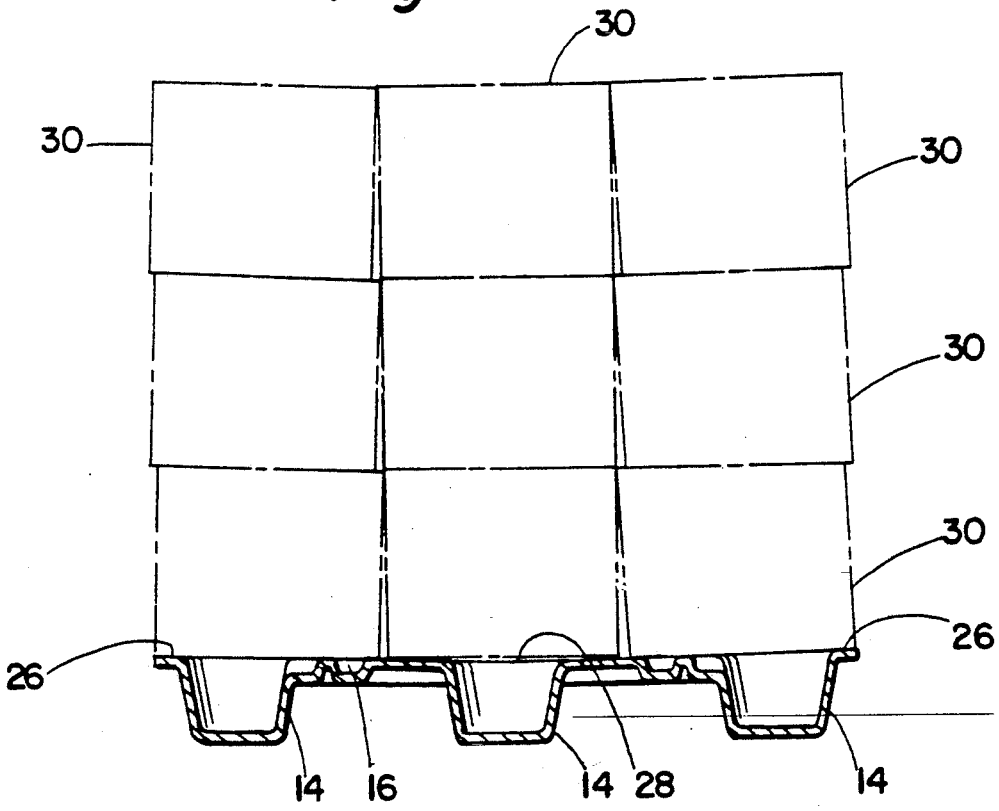
FIG. 4 is a section view taken along line 4—4 of FIG. 2, showing boxes in phantom stacked on the pallet.

Referring now to FIG. 4, the perimeter 26 of the deck 12 is preferrably slightly higher around the entire perimeter 26 than the center portion 28 of the deck 12. This slight incline, or taper, of the surface 12 prevents gaps between stacks of boxes 30 when the pallet 10 is fully stacked. The inventors have demonstrated that a difference in height of as little as eight millimeters between the outer edge 26 and the center 28 may be sufficient to cause the outer stacked boxes to lean slightly towards the center stacked boxes.

Figure 7:
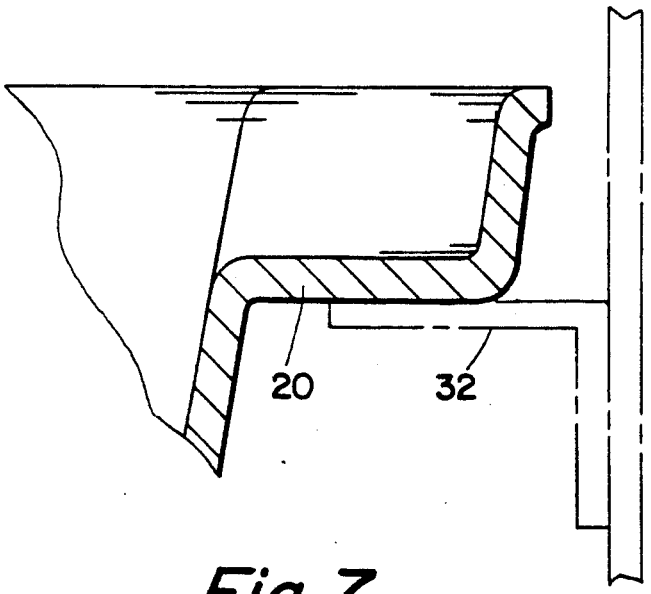
FIG. 7 is a section view of a racking member taken along line 7—7 of FIG. 2, resting on a rack shown in phantom in FIG. 7.

Referring next to FIG. 7, a racking member 20 is detailed. It is sometimes the case that pallets 10 are arranged on racks 32 in ripening rooms, warehouses, etc. As shown in FIG. 2, several racking members 20 may be provided under the surface 12 of the pallet 10 to later be placed on racks 32. The racking members 20 provide enhanced structural integrity and strength of the pallet 10 when the pallet 10 is placed on racks 32.

Although the invention has been described with reference to specific embodiments, variations which would fall within the scope of the following claims will be apparent to those skilled in the art.

What is claimed is:

1. A pallet comprising:

a support surface that is generally smooth and slightly inclined from its perimeter to its center such that the perimeter is higher than the center of the pallet;

reinforcement ribs formed in the surface;

a plurality of ventilation openings formed in the surface; and the pallet being made of one-piece presswood construction.

* * * * *